US005464563A

United States Patent [19]

Moore et al.

[11] Patent Number: 5,464,563

[45] Date of Patent: Nov. 7, 1995

[54] BLEACHING COMPOSITION

[75] Inventors: Samuel B. Moore, Burlington; James F. Leuck, Gibsonville; Edwin T. Turner, Greensboro, all of N.C.

[73] Assignee: Burlington Chemical Co., Inc., Burlington, N.C.

[21] Appl. No.: 112,582

[22] Filed: Aug. 25, 1993

[51] Int. Cl.[6] ..... D06L 3/02

[52] U.S. Cl. ..... 252/186.29; 252/186.28; 8/111; 8/518; 8/519; 162/8; 162/78

[58] Field of Search ..... 252/186.28, 186.29; 8/518, 519, 111; 162/8, 78

[56] References Cited

U.S. PATENT DOCUMENTS

| | | | |
|---|---|---|---|
| 3,617,431 | 11/1971 | Croon et al. | 162/17 |
| 3,740,187 | 6/1973 | Kowalski | 252/186.26 X |
| 3,773,611 | 11/1973 | Woster et al. | 162/25 |
| 3,819,568 | 6/1974 | Taylor | 422/15 |
| 3,860,391 | 1/1975 | Kling et al. | 252/186.25 X |
| 3,898,186 | 8/1975 | Mermelstein et al. | 252/528 |
| 4,337,060 | 11/1982 | Dalmas | 8/111 |
| 4,363,699 | 12/1982 | Deceuster et al. | 162/71 |
| 4,443,355 | 4/1984 | Murata et al. | 252/174.12 |
| 4,496,472 | 1/1985 | Schafer et al. | 252/186 |
| 4,541,944 | 9/1985 | Sanderson | 252/186.38 X |
| 4,725,281 | 2/1988 | Stehlin et al. | 252/186.26 X |
| 4,751,023 | 6/1988 | Stehlin et al. | 252/186.41 |
| 5,114,611 | 5/1992 | Van Kralingen et al. | 252/186.33 |
| 5,250,212 | 10/1993 | de Buzzaccarini et al. | 252/104 |

*Primary Examiner*—Gary L. Geist
*Assistant Examiner*—Valerie Fee
*Attorney, Agent, or Firm*—Rhodes, Coats & Bennett

[57] ABSTRACT

A bleaching composition for cellulosic materials such as paper pulp, cotton and cotton blends. The chemical system of the present invention includes a mixture of sodium hydroxide, optical brighteners and an enhanced hydrogen peroxide including a silicate-free stabilizer. In the preferred embodiment, the silicate-free stabilizer includes; magnesium acetate; phosphonic acid derivative or substituted phosphonic acids; dipicolinic acid; and the balance water. The resulting textile goods are soft, absorbent, silicate-free with a Hunter Scale whiteness of greater than about 85. Because a silicate-free stabilizer is used, low levels of extractable solids are obtained.

8 Claims, No Drawings

BLEACHING COMPOSITION

BACKGROUND OF THE INVENTION

1. Field of the Invention

The present invention relates generally to bleaching cellulosic materials, such as paper pulp, cotton and cotton blends and, more particularly, to a bleaching liquor of sodium hydroxide, optical brighteners and an enhanced hydrogen peroxide including a silicate-free stabilizer to produce goods which are soft, absorbent, silicate-free, and have excellent whiteness values.

2. Description of the Prior Art

Today, the most common type of bleaching process is the oxidation method. This process involves contributing oxygen to the textile material which would result in permanent whiteness. The most common chemicals used in oxidation processes are: (1) Sodium hypochlorite; (2) Hydrogen peroxide; (3) Peracetic acid; and (4) Sodium chlorite.

Of the above four types, hydrogen peroxide is rapidly gaining in popularity because it is nonyellowing, nontoxic, and odorless. In addition, hydrogen peroxide does not have the effluent problem that is associated with chlorine bleaching. For example, during chlorine bleaching, there are chlorinated hydrocarbons that can be formed which are toxic priority pollutants.

Successful bleaching of cellulose which does not change the cellulose occurs when the formation of hydroxyl radicals (—OH) is kept to an absolute minimum. In contrast to the —OOH per anion, the —OH radical is extremely nucleophilic and damaging to the cellulose polymer, therefore, its formation at high temperatures is to be avoided when bleaching is the objective.

A conventional textile bleach bath contains: Sodium hydroxide, surfactant, optical brightener, and stabilizers (silicate or organic). These chemicals are generally mixed in single or multiple head (concentrate) tanks and are automatically diluted before the fabric is saturated.

Alkaline silicates have traditionally been used to stabilize $H_2O_2$ under high temperature conditions at pH's 9–13 and in the presence of cotton fiber which carries a variety of inorganic and organic impurities. It is believed that the silicates, such as sodium silicate, potassium silicate, etc., act as a chelating agent to prevent the metals found in water and on the cotton from catalytically decomposing alkaline $H_2O_2$ by —OH ion formation.

Because silicate/metal or cation complexes are not very soluble, it is common to see silicate deposits build up on cotton bleaching equipment. There are bleach systems that reduce the silicate levels to a few mg/L, but to date, no chemical system has effectively replaced all of the silicate used in textile bleaching despite the deposit problems and the fabric harshness created by silicate.

The use of organic chemical chelates, such as diethylene triamine pentacetic acid (DPTA), other amine chelates phosphates, and polyphosphonates, have dramatically reduced the amount of silicate necessary to produce finely bleached cotton. The efficiency of these chelates, however, can over stabilize alkaline bleach systems to the point that the $H_2O_2$ will not form —OOH bleaching peranion at all. It is known that certain concentrations of monovalent cations, such as calcium or preferably magnesium, will allow for —OOH per anion formation in the presence of silicates and chelates. Therefore, the role of the chelates and silicates as bleach stabilizers is to prevent catalytic destabilization of alkaline $H_2O_2$ that form —OH radicals by preferred chelation of transition metals in the presence of an excess of magnesium or calcium ion.

The success of bleaching cellulose with alkaline $H_2O_2$ depends on producing, as the major $H_2O_2$ decomposition product, perhydroxyl anion or —OOH. The chemical reaction can be shown as follows:

$$H_2O + H_2O_2 \xrightarrow[\text{pH 8–12}]{-OH} -OOH$$

The —OOH anion is non-nucleophilic in nature and releases its oxygen for bleaching slowly without reducing the molecular weight of the cellulose polymer, and its oxygen release can be controlled even at high temperatures by preventing transition metals from acting as catalyst.

Simple solutions of hydrogen peroxide are ineffective in bleaching without additives. However, unstabilized alkaline solutions of hydrogen peroxide produce too fast a rate of decomposition and thus must have a stabilizer to control the rate of hydrogen peroxide decomposition to force the predominant —OOH formation. For example, U.S. Pat. No. 4,363,699 teaches bleaching textile fabrics with hydrogen peroxide, sodium hydroxide and an alphahydroxyacrylic acid polymer stabilizer and U.S. Pat. No. 4,496,472 teaches using hydrogen peroxide, an alkali hydroxide and an oligomer of phosphonic acid ester stabilizer.

Prior bleaching solutions also have used sodium hydroxide along with sodium silicate for stabilization of hydrogen peroxide. For example, U.S. Pat. No. 4,337,060 teaches bleaching textile fabrics with potassium orthosilicate, water and hydrogen peroxide and with the reaction products of sodium silicate and potassium hydroxide. However, as discussed above, silicates form insoluble calcium and magnesium complexes and create a harsh hand on textile goods which can interfere with subsequent dyeing and sewing operations.

Thus, there remains a need for a new and improved bleaching process for paper pulp, cotton and cotton blends which rapidly bleaches to produce excellent whiteness while, at the same time, produces goods which are soft, absorbent, and silicate-free.

SUMMARY OF THE INVENTION

The present invention is directed to a bleaching composition for cellulosic materials such as paper pulp, cotton and cotton blends. The chemical system of the present invention includes a mixture of sodium hydroxide, optical brighteners and an enhanced hydrogen peroxide silicate-free stabilizer. In the preferred embodiment, the silicate-free stabilizer includes hydrogen peroxide; magnesium acetate; phosphonic acid derivative or substituted phosphonic acids; dipicolinic acid; and the balance water. The resulting textile goods are soft, absorbent, silicate-free with a Hunter Scale whiteness of greater than about 85. Because a silicate-free stabilizer is used, low levels of fabric extractables are obtained.

Accordingly, one aspect of the present invention is to provide a liquid composition for use in bleaching cellulosic materials including paper pulp, cotton and cotton blends. The bleaching composition includes sodium hydroxide, a silicate-free stabilizer and hydrogen peroxide. The stabilizer contains magnesium acetate; phosphonic acid derivative or substituted phosphonic acids; dipicolinic acid; and the balance water.

Another aspect of the present invention is to provide a liquid stabilizer for use in bleaching cellulosic materials including paper pulp, cotton and cotton blends. The composition includes: (a) between about 35 to 50 wt % of hydrogen peroxide; (b) between about 0.05 and 1.0 wt % of magnesium acetate; (c) between about 0.01 and 1 wt % phosphonic acid derivative or substituted phosphonic acids; and (d) the balance water.

Another aspect of the present invention is to provide a liquid composition for use in bleaching cellulosic materials including paper pulp, cotton and cotton blends. The composition includes sodium hydroxide, optical brighteners and a silicate-free stabilizer which includes hydrogen peroxide; magnesium acetate; phosphonic acid derivative or substituted phosphonic acids; dipicolinic acid; and the balance water.

Still another aspect of the present invention is to provide a method of bleaching cellulosic materials including paper pulp, cotton and cotton blends. The method includes the steps of: (a) providing a bleach liquor including an alkali hydroxide, a silicate-free stabilizer and water; (b) immersing the cellulosic material in the bleach liquor of step (a); and (c) separating the bleach liquor from the cellulosic materials.

These and other aspects of the present invention will become apparent to those skilled in the art after a reading of the following description of the preferred embodiment.

DESCRIPTION OF THE PREFERRED EMBODIMENTS

In the following description, it is to be understood that such terms as "forward", "rearward", "left", "right", "upwardly", "downwardly", and the like are words of convenience and are not to be construed as limiting terms.

The present invention is a mixture of chelates and a highly purified form of magnesium acetate that is storage stable in commercial strengths of 35% and 50% $H_2O_2$. When the enhanced hydrogen peroxide stabilizer of the present invention is used along with sodium hydroxide and optical brighteners in bleaching, omission of additional stabilizers is possible while producing a satisfactory bleach. The present invention maintains stability of stock grades of $H_2O_2$, i.e. 35% and 50% strengths, in storage without producing decomposition of these high strength $H_2O_2$ solutions.

Although numerous grades of magnesium salts were tried, only magnesium acetate manufactured from very high purity grade MGOH or MGO and glacial acetic acid had sufficiently low iron, copper and other multivalent metal levels to be stable to add high strength $H_2O_2$ solutions. Even low ppm (mg/L) levels of these metals can cause explosive decomposition of concentrated $H_2O_2$ solutions. The present invention provides good peroxide stabilization, even at elevated storage temperatures.

The magnesium acetate was prepared by mixing water, magnesium oxide powder and acetic acid. One source of magnesium oxide is sold under the tradename Magox 98 HR by Premier Refractories and Chemicals of Cleveland, Ohio. The tank was first charged with water. The organic acid was then added while mixing. The magnesium oxide was then added slowly while mixing. Heat will be generated due to the exothermic reaction. The mixture is continued to be mixed for one hour. After mixing, the mixture is cooled and filtered through a one micron filter. Final pH of the mixtures were in the range of 3.0 to 5.0 depending on the acid concentration.

According to the present invention, paper pulp, cotton and cotton blends are bleached in a conventional manner. The bleaching concentrate of the present invention is made using the following chemicals and percentages (percentages based on the weight of the bath (O.W.B.) at a 10:1 ratio of concentrate to bath:

(1) 2% sodium hydroxide-50%

(2) 3% enhanced hydrogen peroxide-35/50%

In addition, the following additional additives may be used:

(3) 2.1% wetter-scour (4) 0.9% optical brighteners

The specific formulation for the enhanced hydrogen peroxide silicate-free stabilizer was determined by experimental design utilizing various amounts of 50% hydrogen peroxide, magnesium acetate, phosphonic acid derivative or substituted phosphonic acids and dipicolinic acid.

In the preferred embodiment, 1-hydroxyethylidene—1,1-diphosphonic acid—sold under the tradenames Dequest 2010 and Mayoquest 1500—are used as the phosphonic acid. Other derivatives or substituted phosphonic acids which should be suitable include: aminotri (methylenephosphonic acid)—Dequest 2000 and Mayoquest 1320; diethylenetriaminepenta (methylenephosphonic acid)—Dequest 2060 and Mayoquest 1860; N-sulfonic acid—N,N-di(methylenephosphonic acid)—Mayoquest 1100; glycine—N,N-di(methylenephosphonic acid)—Mayoquest 1200; N-(2-hydroxyethyl)-N,N-di(methylenephosphonic acid)—Mayoquest 1352; ethylenediaminetetra (methylenephosphonic acid)—Dequest 2041; and hexamethylenediaminetetra (methylenephosphonic acid)—Dequest 2051.

The present invention can best be understood after a review of the following examples:

EXAMPLES 1–17

Various amounts of 50% hydrogen peroxide, 30% active magnesium acetate, 60% active phosphonic acid and dipicolinic acid were mixed together and tested for hydrogen peroxide retention at 49 C. for up to 37 days.

Table 1 compares the long term stability of the above mixtures by measuring the % retained activity of the solution.

TABLE 1

Stability Values for Various Additions of MgAC, Phosphonic, and Dipicolinic Acids

| Ex. | $H_2O_2$-50 % | MgAC-30 % | Phosph-60 % | Dipi % | % Retained Activity |
|---|---|---|---|---|---|
| 1 | 98.10 | 0.150 | 1.500 | 0.25 | 96.0 |
| 2 | 97.00 | 1.500 | 1.000 | 0.50 | 98.0 |
| 3 | 97.00 | 1.000 | 1.500 | 0.50 | 106.0 |
| 4 | 98.40 | 1.500 | 0.100 | 0.00 | 98.0 |
| 5 | 97.00 | 1.500 | 1.500 | 0.00 | 99.0 |
| 6 | 99.25 | 0.650 | 0.100 | 0.00 | 92.0 |
| 7 | 98.57 | 0.825 | 0.100 | 0.50 | 109.0 |
| 8 | 98.10 | 0.150 | 1.500 | 0.25 | 101.0 |
| 9 | 97.70 | 1.500 | 0.800 | 0.00 | 103.0 |
| 10 | 97.00 | 1.500 | 1.500 | 0.00 | 106.0 |
| 11 | 99.25 | 0.150 | 0.100 | 0.50 | 100.0 |
| 12 | 99.25 | 0.150 | 0.100 | 0.50 | 96.0 |
| 13 | 97.67 | 0.825 | 1.500 | 0.00 | 100.0 |
| 14 | 99.25 | 0.150 | 0.600 | 0.00 | 106.0 |
| 15 | 98.80 | 0.150 | 1.050 | 0.00 | 107.0 |
| 16 | 97.90 | 1.500 | 0.100 | 0.50 | 101.0 |
| 17 | 98.13 | 0.825 | 0.800 | 0.25 | 102.0 |

As can be seen, there is a good effect from combinations of MgAC, phosphonic acid derivative or substituted phosphonic acids, and dipicolinic acid with the major stabilization effects seen with MgAC and phosphonic acid derivative or substituted phosphonic acids.

EXAMPLES 18–34

Various amounts of 50% hydrogen peroxide, 30% active magnesium acetate, 60% active phosphonic acid and dipicolinic acid were mixed together and tested for alkali stability during bleaching. The bleaching bath, sans fabric, contained 3.5% enhanced peroxide and 2% NAOH-50%. The bath temperature was 190° F. and was held for 30 minutes.

Table 2 compares the alkali stability of the above mixtures.

TABLE 2

| | Stability Values for Various Additions of MgAC, Phosphonic, and Dipicolinic Acids | | | | |
|---|---|---|---|---|---|
| Ex. | $H_2O_2$-50 % | MgAC-30 % | Phosph-60 % | Dipi % | Alk-Stab % loss |
| 18 | 98.10 | 0.150 | 1.500 | 0.25 | 28.7 |
| 19 | 97.00 | 1.500 | 1.000 | 0.50 | 0.0 |
| 20 | 97.00 | 1.000 | 1.500 | 0.50 | 1.0 |
| 21 | 98.40 | 1.500 | 0.100 | 0.00 | 0.0 |
| 22 | 97.00 | 1.500 | 1.500 | 0.00 | 0.0 |
| 23 | 99.25 | 0.650 | 0.100 | 0.00 | 5.3 |
| 24 | 98.57 | 0.825 | 0.100 | 0.50 | 3.3 |
| 25 | 98.10 | 0.150 | 1.500 | 0.25 | 28.5 |
| 26 | 97.70 | 1.500 | 0.800 | 0.00 | 3.1 |
| 27 | 97.00 | 1.500 | 1.500 | 0.00 | 1.0 |
| 28 | 99.25 | 0.150 | 0.100 | 0.50 | 31.8 |
| 29 | 99.25 | 0.150 | 0.100 | 0.50 | 37.8 |
| 30 | 97.67 | 0.825 | 1.500 | 0.00 | 14.1 |
| 31 | 99.25 | 0.150 | 0.600 | 0.00 | 38.3 |
| 32 | 98.80 | 0.150 | 1.050 | 0.00 | 51.6 |
| 33 | 97.90 | 1.500 | 0.100 | 0.50 | 43.0 |
| 34 | 98.13 | 0.825 | 0.800 | 0.25 | 8.5 |

The less available oxygen loss (AVOX) indicates stable —OOH anion formation and a resistance to —OH radical decomposition of the $H_2O_2$. When zero % AVOX loss is seen, the effect of the stabilizer chemistry is clearly evident.

EXAMPLES 35–51

Test runs were made with a conventional bleaching range under the conditions described below for various dwell times and temperatures. Articles are introduced into the first section of the bleaching range as follows: The water in the range is preheated to 200 F. and the first section is filled with 10 gallons of the above bleaching concentrate per 100 gallons water. The liquor ratio is maintained at approximately 10:1 (10 parts water to 1 part fabric). Enough sections of the bleach range are used to allow the fabric a dwell time of 8 minutes. The treated goods were soft, absorbent, silicate-free, and had excellent whiteness values on a Hunter Scale of greater than about 85.

Table 3 compares the whiteness of the goods measured according to the Hunter Whiteness Scale. The caustic soda-50% and other additives, and the temperature is the same as Table 2.

TABLE 3

| | Whiteness Values for Various Additions of MgAC, Phosphonic, and Dipicolinic Acids | | | | |
|---|---|---|---|---|---|
| Ex. | $H_2O_2$-50 % | MgAC-30 % | Phosph-60 % | Dipi % | Whiteness Hunter |
| 35 | 98.10 | 0.150 | 1.500 | 0.25 | 86.8 |
| 36 | 97.00 | 1.500 | 1.000 | 0.50 | 85.7 |
| 37 | 97.00 | 1.000 | 1.500 | 0.50 | 88.1 |
| 38 | 98.40 | 1.500 | 0.100 | 0.00 | 87.5 |

TABLE 3-continued

| | Whiteness Values for Various Additions of MgAC, Phosphonic, and Dipicolinic Acids | | | | |
|---|---|---|---|---|---|
| Ex. | $H_2O_2$-50 % | MgAC-30 % | Phosph-60 % | Dipi % | Whiteness Hunter |
| 39 | 97.00 | 1.500 | 1.500 | 0.00 | 87.2 |
| 40 | 99.25 | 0.650 | 0.100 | 0.00 | 86.9 |
| 41 | 98.57 | 0.825 | 0.100 | 0.50 | 85.0 |
| 42 | 98.10 | 0.150 | 1.500 | 0.25 | 83.5 |
| 43 | 97.70 | 1.500 | 0.800 | 0.00 | 87.5 |
| 44 | 97.00 | 1.500 | 1.500 | 0.00 | 75.2 |
| 45 | 99.25 | 0.150 | 0.100 | 0.50 | 86.2 |
| 46 | 99.25 | 0.150 | 0.100 | 0.50 | 86.9 |
| 47 | 97.67 | 0.825 | 1.500 | 0.00 | 88.2 |
| 48 | 99.25 | 0.150 | 0.600 | 0.00 | 87.5 |
| 49 | 98.80 | 0.150 | 1.050 | 0.00 | 87.3 |
| 50 | 97.90 | 1.500 | 0.100 | 0.50 | 87.0 |
| 51 | 98.13 | 0.825 | 0.800 | 0.25 | 88.1 |

As can be seen from Tables 1–3, good bleach bath stabilities, good storage stability of the enhanced commercial peroxide solutions, and excellent whiteness values were obtained by enhanced peroxide solutions at 3.5% owg. and 2% NAOH-50 at 190° F. for 30 minutes.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A liquid, silicate-free bleach composition for use in bleaching cellulosic materials including paper pulp, cotton and cotton blends, said composition comprising:

(a) between about 35 to 50 wt % of hydrogen peroxide;

(b) between about 0.05 to 1.0 wt % of magnesium acetate;

(c) between about 0.01 to 0.1 wt % aminoalkylphosphonic acid; and (d) the balance water.

2. The composition according to claim 1, further including about 0.01 to 0.1 wt % of dipicolinic acid.

3. A stabilized, silicate-free, hydrogen peroxide composition for use in bleaching cellulosic materials including paper pulp, cotton and cotton blends, said composition comprising:

(a) about 35 to 50 wt % hydrogen peroxide, (b) magnesium acetate, and (c) an aminoalkylphosphonic acid.

4. The composition of claim 3, further containing dipicolinic acid.

5. The composition of claim 4, wherein dipicolinic acid comprises up to about 0.1% of said composition.

6. The composition of claim 3, wherein magnesium acetate comprises up to 1.0% of said composition.

7. The composition of claim 3, wherein the aminoalkylphosphonic acid comprises up to about 1.0% of said composition.

8. A stabilized, silicate-free, hydrogen peroxide composition comprising:

(a) about 35 to 50 wt % hydrogen peroxide, (b) about 0.05% to 1.0% magnesium acetate, (c) about 0.01% to 1.0% aminoalkylphosphonic acid, and (d) about 0.01% to 0.1% dipicolinic acid.

* * * * *